US005461275A

United States Patent [19]

Oshima

[11] Patent Number: 5,461,275

[45] Date of Patent: Oct. 24, 1995

[54] SPARK PLUG FOR USE IN AN INTERNAL COMBUSTION ENGINE

[75] Inventor: Takafumi Oshima, Nagoya, Japan

[73] Assignee: NGK Spark Plug Co., Ltd., Nagoya, Japan

[21] Appl. No.: 277,993

[22] Filed: Jul. 20, 1994

[30] Foreign Application Priority Data

Jul. 23, 1993 [JP] Japan ..... 5-183095

[51] Int. Cl.[6] ..... H01T 1/22

[52] U.S. Cl. ..... 313/141; 123/169 EL; 313/144

[58] Field of Search ..... 313/141, 139, 313/142, 144, 143; 123/169 EL

[56] References Cited

U.S. PATENT DOCUMENTS 4,122,366 10/1978 Von Stutterheim et al. ..... 313/142 X
5,273,474 12/1993 Oshima et al. ..... 313/141 X
5,347,193 9/1994 Oshima et al. ..... 313/141

FOREIGN PATENT DOCUMENTS 2-49388 2/1990 Japan .
1564335 4/1980 United Kingdom .

*Primary Examiner*—Sandra L. O'Shea
*Assistant Examiner*—Ashok Patel
*Attorney, Agent, or Firm*—Sughrue, Mion, Zinn, Macpeak & Seas

[57] ABSTRACT

In a spark plug having a nickel-based electrode whose front end has a firing tip made from a ruthenium- or iridium-based metal in which an oxide of a rare earth metal group is dispersed, the firing tip is welded to the electrode by a solidified alloy layer having a component of the electrode and a component of the firing tip. The firing tip contains the oxide of the rare earth metal group in a range of 5~15% by volume (V), and an average grain size (D) of the oxide is in a range of 0.05~ 3.0 μm with a quantitative relationship as $D \leqq -0.34V+5.1$.

1 Claim, 7 Drawing Sheets

Ir-5Vol% yttria, average grain size: 1μm

Ir-7.5Vol% yttria, average grain size: 1μm

Ir-10Vol% yttria, average grain size: 3μm

SPARK PLUG FOR USE IN AN INTERNAL COMBUSTION ENGINE

BACKGROUND OF THE INVENTION

1. Field of the Invention

This invention relates to a spark plug having an electrode whose front end has a spark-erosion resistant tip made from a ruthenium- or iridium-based metal in which an oxide of a rare earth metal group is dispersed.

2. Description of Prior Art

In a spark plug electrode, a firing tip is introduced which is made from a high melting point metal such as ruthenium or iridium or the like. In the metal, an oxide (yttria) of a rare earth metal group is dispersed in order to improve a spark-erosion resistant property as shown by Japanese Patent Publication No. 52-118137.

In Japanese Patent Publication No. 2-49388, a firing tip is secured to a front end of a nickel-based electrode by means of laser or electron beam welding. The firing tip is made of an iridium-based metal containing platinum in less than 50% by weight.

The laser or electron beam welding causes to locally apply thermal energy to the firing tip and the front end of the electrode so as to form a solidified alloy layer therebetween. In this instance, the oxide of the rare earth metal group tends to coagulate or segregate in the solidified alloy layer so as to appear blow holes. This tendency becomes more remarkable as the oxide in the firing tip increases.

These blow holes cause thermal stress to develop cracks in the solidified alloy layer due to heat and cool cycles when the spark plug electrode is applied to an internal combustion engine. At the worst case, the cracks eventually leads to exfoliate or fall the firing tip from the front end of the electrode to significantly shorten a service life of the spark plug.

In order to avoid the exfoliation of the firing tip, it is considered to decrease an amount of the oxide of the rare earth metal group. However, the decrease the amount of the oxide results in declining the firing tip of the spark-erosion resistant property.

Therefore, it is an object of the invention to provide a spark plug which is capable of reducing a spark discharge voltage, and preventing blow holes and cracks from occurring in a solidified alloy layer between a firing tip and a front end of an electrode without inviting a loss of the spark-erosion resistant property.

SUMMARY OF THE INVENTION

On the basis of repeated experiment tests carried out to attain the object, it is found that although the oxide of the rare earth metal group tends to coagulate or segregate in the solidified alloy layer to appear blow holes as the oxide in the firing tip increases, the tendency becomes more remarkable when an amount of the oxide of the rare earth metal group exceeds 15% by volume.

It is also found that developement of the blow holes is effectively controlled when an average grain size of the oxide of the rare earth metal group is in a range of 0.05~3.0 μ, although the blow holes tend to develop in the solidified alloy layer as the average grain size of the oxide becomes greater.

In reducing the spark discharge voltage, it is necessary to contain an amount of the oxide greater than 5% by volume, and it is required to determine the amount of the oxide in a range of 5~20% by weight so as to maintain a good spark-erosion resistant property.

The invention aims to provide a spark plug which is capable of reducing a spark discharge voltage, and preventing blow holes and cracks from occurring in a solidified alloy layer between a firing tip and a front end of an electrode without inviting a loss of the spark-erosion resistant property.

According to the invention, there is provided a spark plug having a nickel-based electrode whose front end has a firing tip made from a ruthenium- or iridium-based metal in which an oxide of a rare earth metal group is dispersed. The firing tip is welded to the electrode by a solidified alloy layer having a component of the electrode and a component of the firing tip. The firing tip contains the oxide of the rare earth metal group in a range of 5~15% by volume (V), and an average grain size (D) of the oxide is in a range of 0.05~ 3.0 μm with a quantitative relationship as $D \leqq -0.34V + 5.1$.

This enables to effectively avoid occurrence of blow holes in the solidified alloy layer, thus preventing the thermal stress to develop cracks in the solidified alloy layer due to heat and cool cycles when the spark plug electrode is applied to an internal combustion engine, while reducing the spark discharge voltage without declining the firing tip of the spark-erosion resistant property.

These and other objects and advantages of the invention will be apparent upon reference to the following specification, attendant claims and drawings.

DETAILED DESCRIPTION OF THE EMBODIMENT OF THE INVENTION

Figure 1:
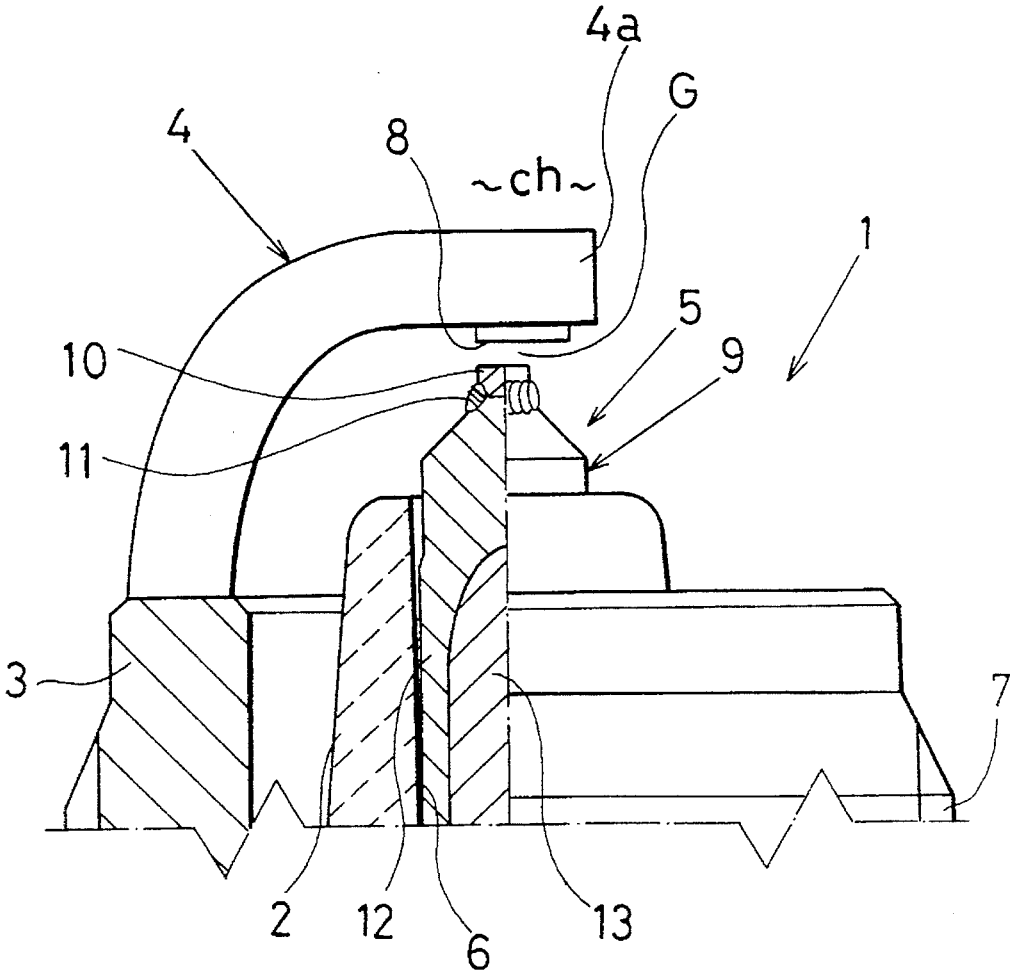
FIG. 1 is a plan view of a lower portion of a spark plug according to an embodiment of the invention, but its left half is sectioned.

Referring to FIG. 1 which show a lower portion of a spark plug 1 for an internal combustion engine, the spark plug 1 has a metallic shell 3 in which a tubular insulator 2 is placed. To a lower end of the metallic shell 3, a L-shaped ground electrode 4 is secured by means of electric resistance welding or the like so as to form a spark gap G with a front end of a center electrode 5. The insulator 2 is made from a ceramic body sintered with aluminum oxide or aluminum nitride as a main component. The insulator 2 has an inner space to serve as an axial bore 6 in which the center electrode 5 is concentrically placed.

The metallic shell 3 is cylindrically made of a low carbon steel or the like so as to form a housing of the spark plug 1. On an outer surface of the metallic shell 3, a male thread portion 7 is provided through which the spark plug 1 is mounted on a cylinder head (not shown) of the internal combustion engine.

A front end 4*a* of the ground electrode 4 extends into a combustion chamber (Ch) of the internal combustion engine, and having a noble metal tip 8 in a manner to oppose the front end of the center electrode 5. By way of illustration, the noble metal tip 8 is made of platinum-iridium or platinum-nickel based alloy, and secured to the front end 4*a* of the ground electrode 4 by means of laser, electron beam or electric resistance welding.

Figure 2:
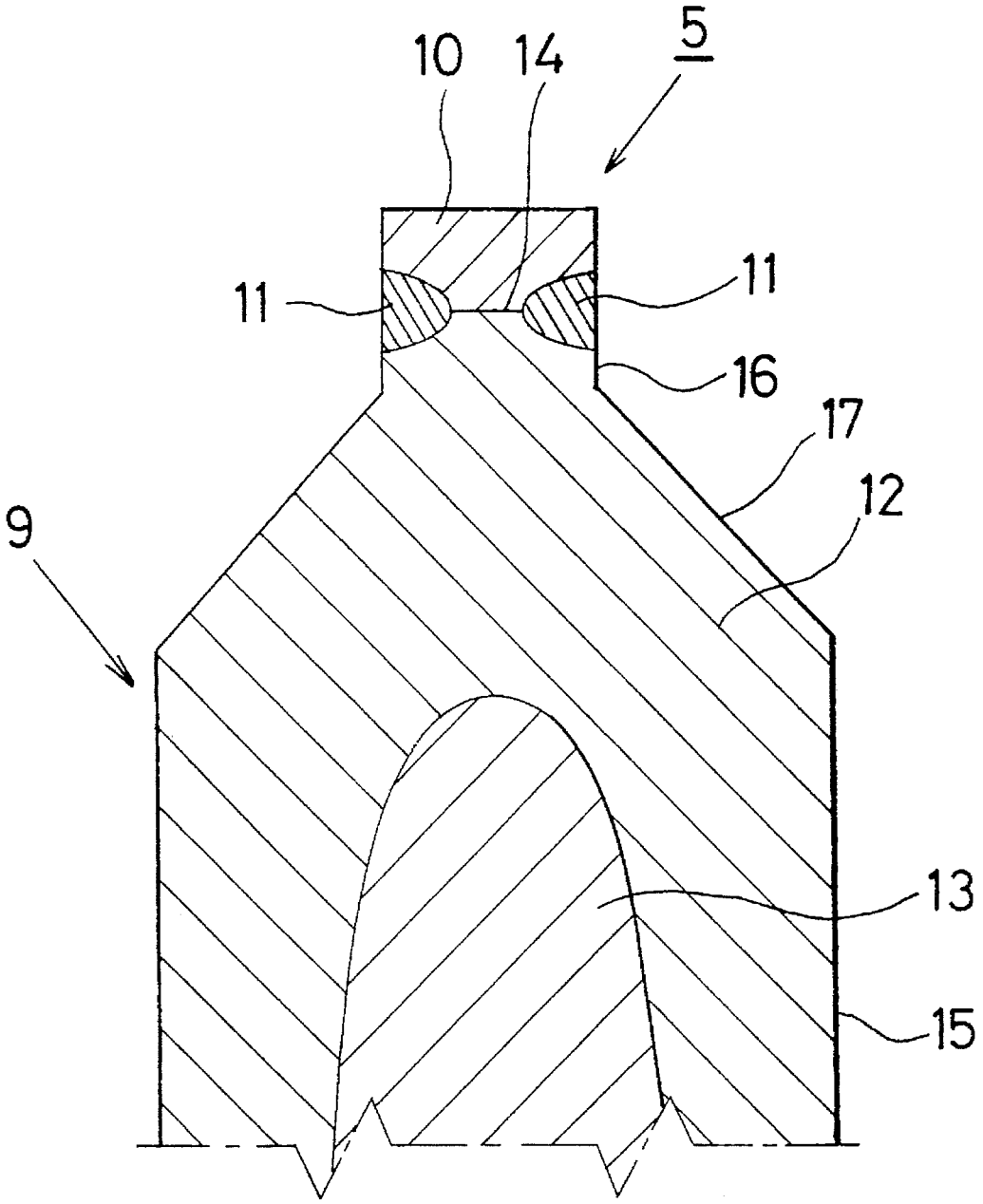
FIG. 2 is a longitudinal cross sectional view of a front portion of a center electrode of the spark plug.

As shown in FIG. 2, the center electrode 5 includes a columnar metal 9 having a nickel-based clad metal 12 and a good heat-conductive core 13 which is made of silver, copper or the like. A disc-like firing tip 10 is placed on a front end surface 14 of the clad metal 12, and a solidified alloy layer 11 is formed between the firing tip 10 and the front end surface 14 of the clad metal 12 as described in detail hereinafter.

The columnar metal 9 of the center electrode 5 is supported in axial bore 6 of the insulator 2 by means of well-known glass sealant with the front end of the metal 9 somewhat extended beyond the insulator 2. The clad metal 12 of the columnar metal 9 is made of heat and erosion resistant Si-Mn-Cr-Ni alloy or Cr-Fe-Ni alloy (Inconel). In the clad metal 12, the core metal 13 is concentrically embedded which may be made with the good heat-conductive copper, silver or copper-based alloy, silver-based alloy.

The firing tip 10 is a ceramic body which is made by sintering a high melting point metal such as iridium (Ir) or ruthenium (Ru) in which an oxide of a rare earth metal group is evenly dispersed. The oxide of the rare earth metal group is examplified as yttria ($Y_2O_3$), lanthana ($La_2O_3$) or the like. The firing tip 10 is secured to the front end surface 14 of the clad metal 12 by means of laser or electron beam welding. This type of welding procedure causes to provide the solidified alloy layer 11 between the firing tip 10 and the front end surface 14 of the clad metal 12. The solidified alloy layer 11 has a component of the clad metal 12 and a component of the firing tip 10 so as to provide an alloy consisting of the nickel-based metal, the high melting point metal and the oxide of the rare earth metal group.

Figure 3A:
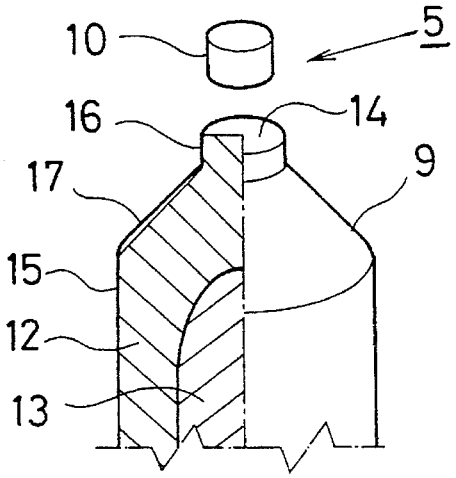
FIGS. 3*a*~3*c* are sequential views showing how the center electrode is manufactured.

The solidified alloy layer 11 is provided as follows:

(i) A diameter-reduced neck 16 is provided on a clad metal portion extended beyond the insulator 2 by means of plastic working or cutting procedure as shown in FIG. 3*a*. The diameter-reduced neck 16, which measures e.g. 0.85 mm in diameter and 0.25 mm in height, is diametrically smaller than a barrel portion 15 of the clad metal 12. A cone-shaped portion 17 is provided between the diameter-reduced neck 16 and the barrel portion 15 of the clad metal 12 by means of plastic working or cutting procedure.

Figure 3B:
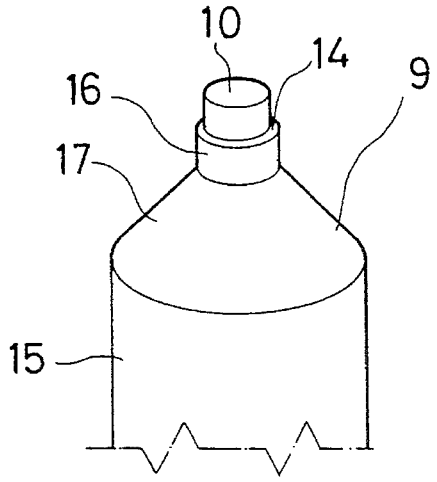

(ii) Upon attending to the firing tip 10 which is made by sintering iridium (Ir) or ruthenium (Ru) in which yttria ($Y_2O_3$), lanthana ($La_2O_3$) or the like is evenly dispersed, the firing tip 10 is placed on the front end surface 14 of the diameter-reduced neck 16 of the clad metal 12 as shown in FIG. 3*b*.

In this instance, the firing tip 10 contains the oxide of the rare earth metal group in a range of 5~15% by volume (V), and an average grain size (D) of the oxide is in a range of 0.05~3.0 μm with a quantitative relationship as $D \leqq -0.34V+5.1$.

Figure 3C:
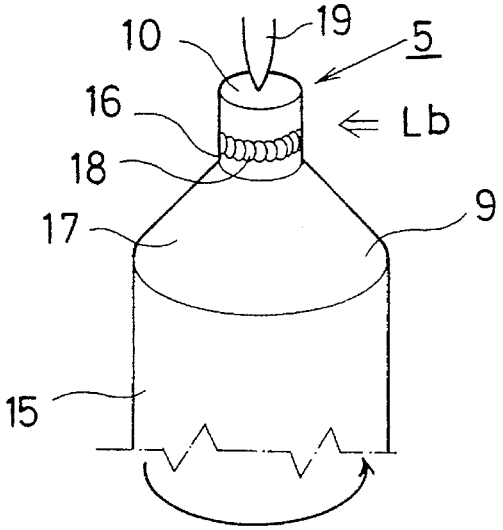

(iii) Upon carrying out the laser beam welding, YAG laser beams (Lb) are intermittently applied generally in parallel to an interface between the firing tip 10 and the front end surface 14 of the diameter-reduced neck 16 of the clad metal 12 while applying pressing the firing tip 10 against the front end surface 14 of the diameter-reduced neck 16 by means of a jig 19 as shown in FIG. 3*c*. In this instance, the columnar metal 9 is rotated around its axis while circumferentially applying the laser beams (Lb) several times to partially overlap neighboring shot spots 18 with one shot as 2.0 J.

This makes it possible to provide the solidified alloy layer 11 between the firing tip 10 and the front end surface 14 of the diameter-reduced neck 16 of the clad metal 12 substantially all through their circumferential length after gradually cooling the melted components of the firing tip 10 and the clad metal 12. That is to say, the solidified alloy layer 11 is a metallurgical integration consisting of nickel, the high melting point metal (Ir, Ru) and the oxide ($Y_2O_3$, $La_2O_3$) of the rare earth metal group.

Figure 4:
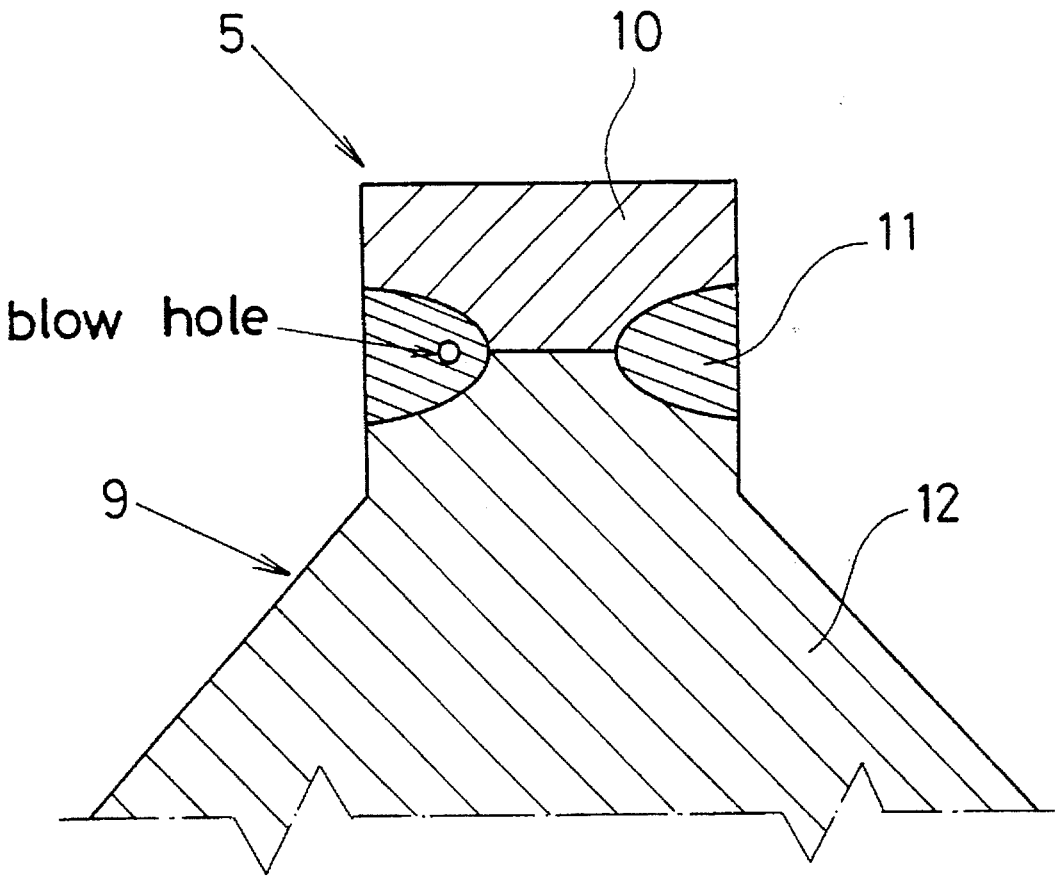
FIG. 4 is a schematic view showing how cracks occur in a solidified alloy layer between a firing tip and a front end of the center electrode.

It is observed that the solidified alloy layer 11 tends to quickly adsorb oxygen and nitrogen so as to provide a gaseous component while decomposing the oxide of the rare earth metal group due to the considerably high temperature when the firing tip 10 and the clad metal 12 are thermally melted during the laser welding procedure. As shown in FIG. 4, the gaseous component created inside the solidified alloy layer 11 is supposed to form blow holes during which the oxide of the rare earth metal group is coagulated of segregated although the gaseous component in the melted alloy decreases with the descent of the ambient temperature.

In order to avoid the above drawbacks, various experimental tests are carried out to investigate occurrence of the blow holes, the spark discharge voltage and the spark-erosion resistant property by changing the amount and the average grain size of the oxide of the rare earth metal group.

Figure 5:
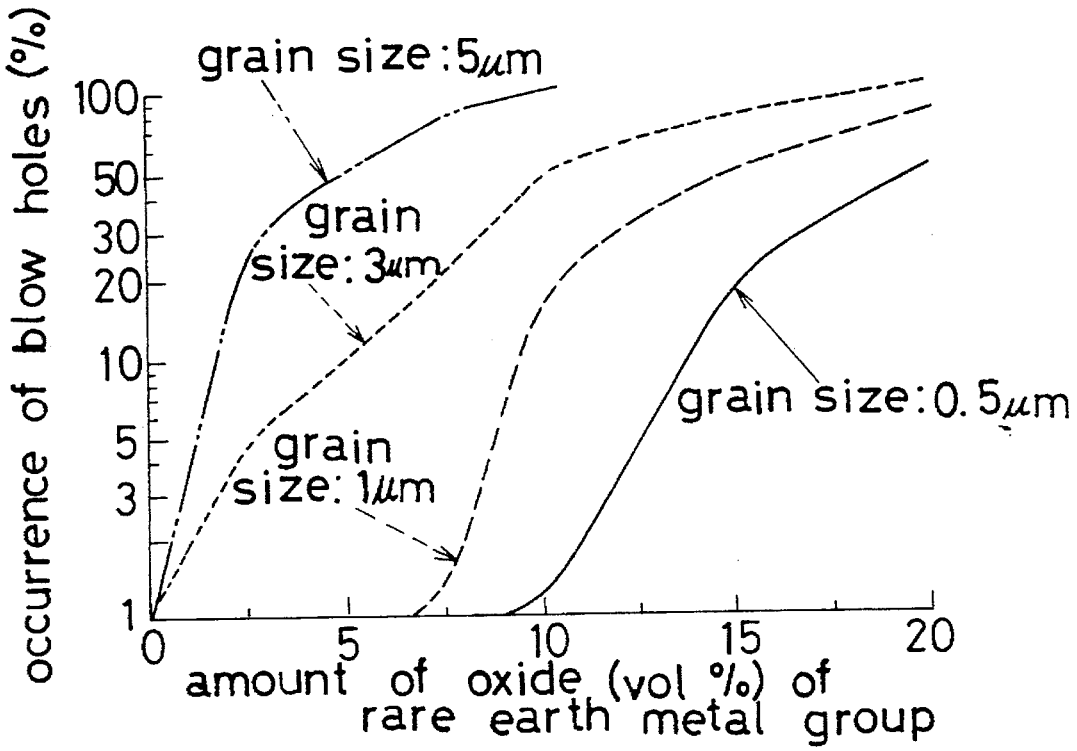
FIG. 5 is a graph showing a relationship between occurrence (%) of blow holes and an amount of oxide (vol %) of a rare earth metal group.

Upon carrying out these experimental tests, four types of specimens of yttria ($Y_2O_3$) are prepared whose average grain size are in turn 5 μm, 3 μm, 1 μm and 0.5 μm as the oxide of the rare earth metal group. Each of the specimens is added to a powder of the high melting point metal (Ir) in the range of 0~20% by volume. The mixture of each specimen and the iridium powder is pressed and metallurgically sintered under predetermined conditions so as to form respective firing tips. Each of the firing tips is laser welded to the front end surface of the clad metal of the columnar metal. Then the occurrence of the blow holes is inspected by structurally observing sectioned surfaces of the solidified alloy layers on the basis of every twenty specimens. The experimental test result is shown in FIG. 5 which indicates that the occurrence of the blow holes becomes greater with the increase of the yttria ($Y_2O_3$) irrespective of whether its grain size is 5 μm, 3 μm, 1 μm or 0.5 μm. The occurrence of the blow holes increases with the increase of the grain size of the yttria ($Y_2O_3$). In particular, the occurrence of the blow holes remarkably increases when the addition of the yttria ($Y_2O_3$) exceeds 15% by volume.

Conversely, it is found that the occurrence of the blow holes is effectively reduced when the addition of the yttria ($Y_2O_3$) is less than 15% by volume with its grain size in the range of 0.5~3.0 μm. It can be ascertained that the occurrence of the blow holes is completely avoided when the addition of the yttria ($Y_2O_3$) is less than 7% by volume with its grain size in less than 1.0 μm.

Figure 6:
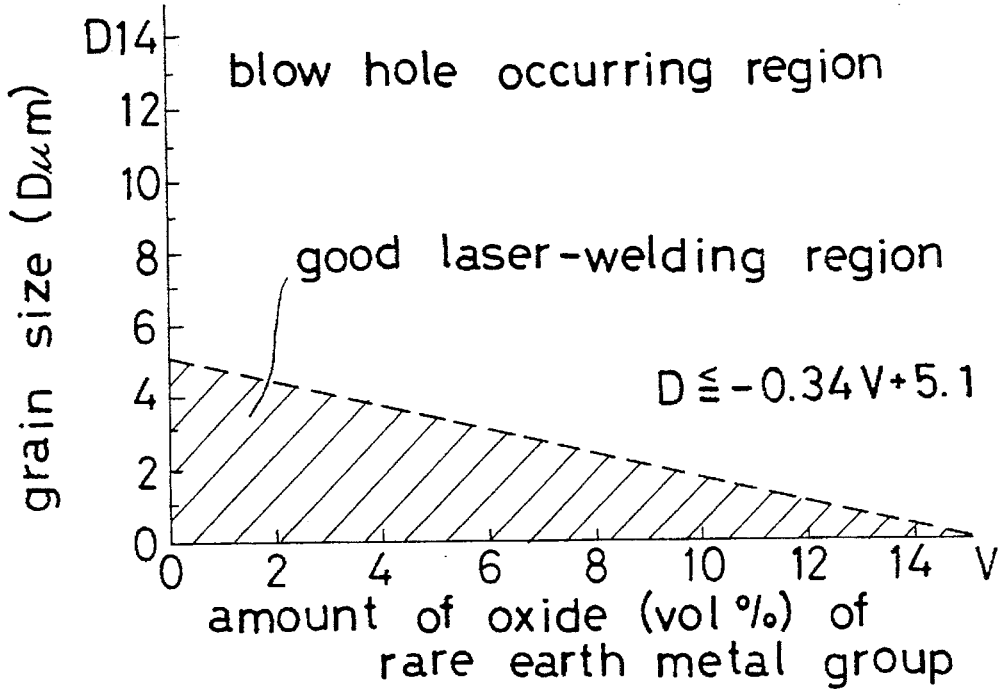
FIG. 6 is a graph showing a relationship between grain size (μm) of the oxide and the amount of oxide (vol %) of a rare earth metal group.

FIG. 6 is a graph showing a relationship between the grain size (D μm) and an added amount of the oxide (V %) of the rare earth metal group. A good laser-welding region is depicted as hatched in FIG. 6 when the occurrence of the blow holes is less than 10%. In order to define the hatched area in FIG. 6, an inequality is determined as $D \leqq -0.34V + 5.1$.

Namely the occurrence of the blow holes depends on the average grain size of the oxide of the rare earth metal group although the occurrence of the blow holes generally increases when the oxide ($Y_2O_3$) is added to the high melting point metal (Ir). When the average grain size of the oxide of the rare earth metal group is greater, grains of the oxide tends to coagulate each other so as to facilitate the blow holes in the solidified alloy layer 11. When the average grain size of the oxide of the rare earth metal group is smaller, it is possible to effectively prevent the grains of the oxide from coagulating each other so as to favorably control the blow holes in the solidified alloy layer 11 under the increased addition of the oxide of the rare earth metal group.

The reduced occurrence of the blow holes makes it possible to effectively avoid the thermal stress which eventually causes cracks in the solidified alloy layer 11 due to the heat and cool cycles when the spark plug 1 is in use for the internal combustion engine. As a result, it is possible to sufficiently prevent the firing tip 10 from exfoliating or falling off the columnar metal 9 so as to prolong the service life of the spark plug 1.

Figure 7A:
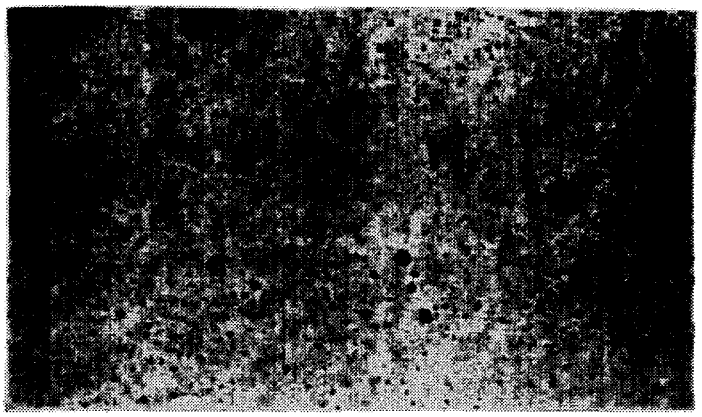
FIGS. 7*a*~7*c* are microscopic photographs of metallic structure of the firing tip.

FIG. 7*a* is a microscopic photograph showing a metallical structure of a sectional surface of the iridium-based alloy containing yttria of 5% by volume whose average grain size is 1 μm.

Figure 7B:
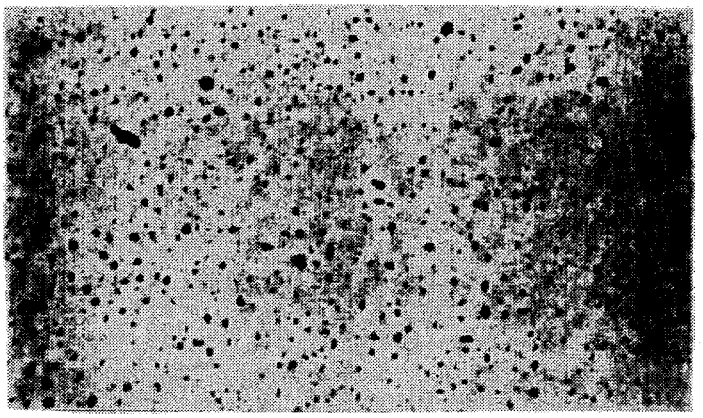

FIG. 7*b* is a microscopic photograph showing a metallical structure of a sectional surface of the iridium-based alloy containing yttria of 7.5% by volume whose average grain size is 1 μm.

Figure 7C:
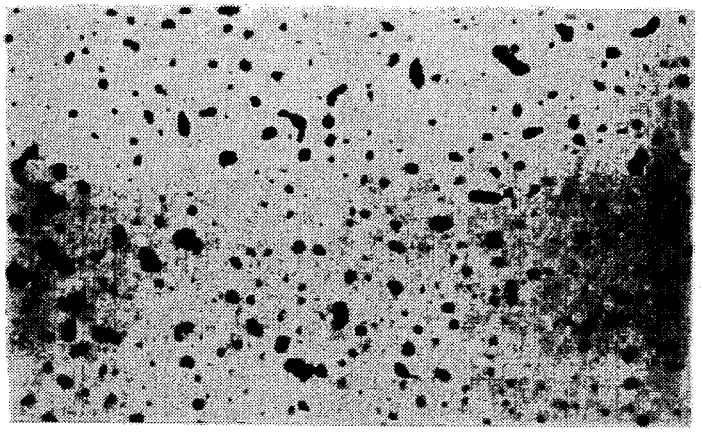

FIG. 7*c* is a microscopic photograph showing a metallical structure of a sectional surface of the iridium-based alloy containing yttria of 10% by volume whose average grain size is 3 μm.

It is noted that the microscopic photographs in FIGS. 7*a*, 7*b* and 7*c* are magnified by 1000 times in which black dots indicates the existance of yttria.

Figure 8:
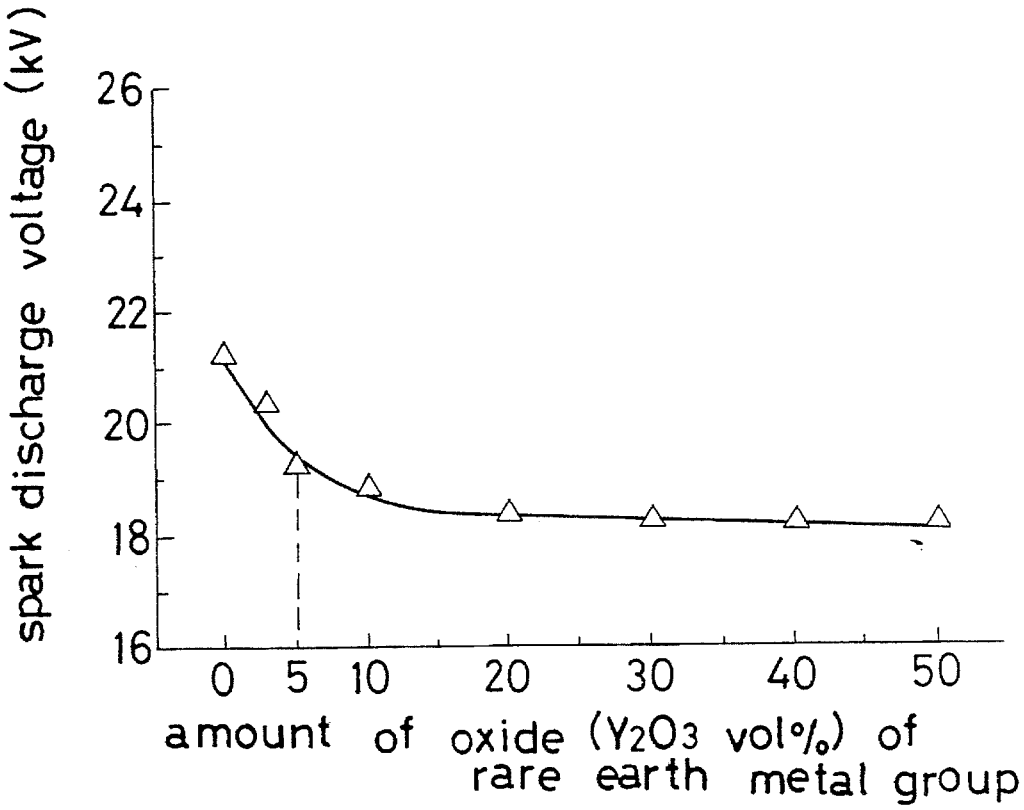
FIG. 8 is a graph showing a relationship between a spark discharge voltage (kV) and the amount of oxide (vol %) of a rare earth metal group.

Then an experimental test is carried out to determine a relationship between the spark discharge voltage (kV) and an added amount of the oxide (vol %) of the rare earth metal group. A specimen used for the experimental test as a firing tip is made by adding 0~50% yttria ($Y_2O_3$) by volume to the high melting point metal (Ir). The firing tip 10 is laser welded to the front end surface 14 of the clad metal 12 of the columnar metal 9 so as to form the center electrode 5 of the spark plug 1. In order to investigate the spark discharge voltage (kV), the spark plug 1 is mounted on an internal combustion engine with natural gas as an engine fuel. The experimental test result is shown in FIG. 8 which indicates the spark discharge voltage (kV) upon running (2200 rpm) the internal combustion engine at a predetermined load with an ignition advancement angle measured in term of BTDC15°CA. The BTDC15°CA is an acronym of Before Top Dead Center 15 degrees in Crank Angle.

As apparent from FIG. 8, the spark discharge voltage is reduced to less than 19.5 kV with the addition of the oxide ($Y_2O_3$) exceeding 5% by volume. This is because an electric field is locally intensified with the increased addition of the oxide of the rare earth metal group. By increasing the addition of the oxide ($Y_2O_3$) to exceed 5% by volume, it is possible to sufficiently reduce the spark discharge voltage of the spark plug 1.

Another experimental test is carried out to determine a relationship between the spark-erosion and an added amount of the oxide (vol %) of the rare earth metal group. A specimen used for the experimental test as a firing tip is made by adding 5~50% yttria ($Y_2O_3$) or lanthana ($La_2O_3$) by volume to the high melting point metal (Ir). In order to investigate the spark erosion, the firing tip is exposed to an inductive energy of 60 mJ which is generated by an ignition source (not shown). The experimental test result is shown in FIG. 9 in which triangular legends represent the cases when yttria ($Y_2O_3$) is used, and circular legends represent the cases when lanthana ($La_2O_3$) is employed.

Figure 9:
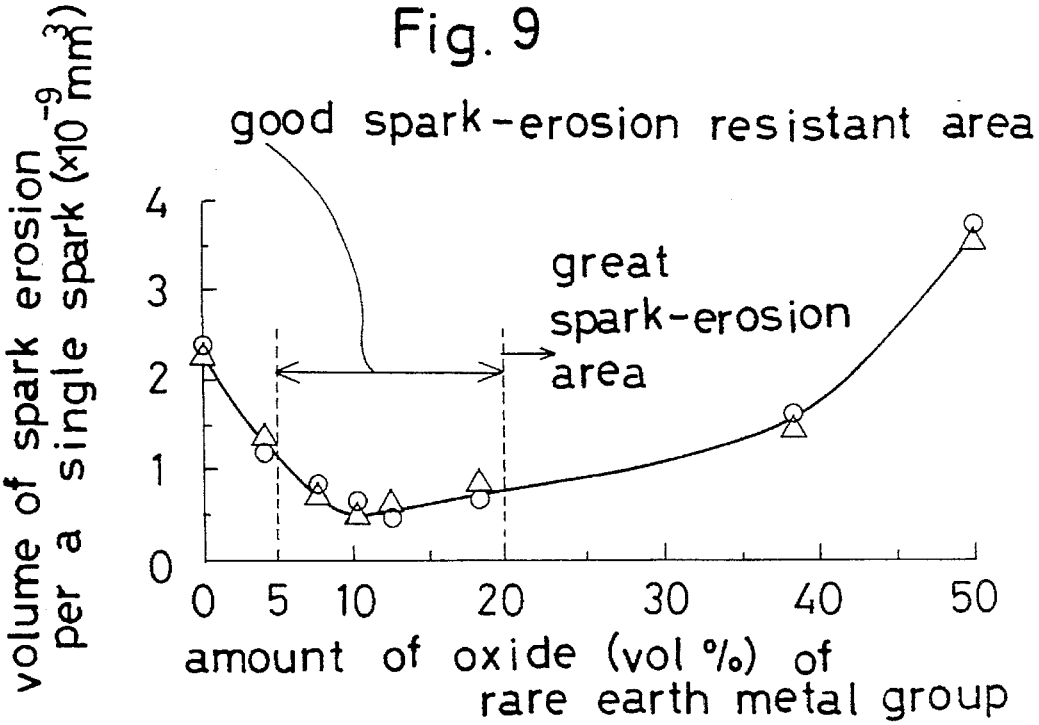
FIG. 9 is a graph showing a relationship between volume of spark erosion per a single spark and the amount of oxide (vol %) of a rare earth metal group.

It is evident from FIG. 9 that the spark erosion is remarkably controlled by adding the oxide of the rare earth metal group in the order of 10% by volume regardless of whether the oxide is yttria ($Y_2O_3$) or lanthana ($La_2O_3$). However, no significant reduction of the spark erosion is effected when the added amount of the oxide decreases to less than 5% by volume. This is because iridium (Ir) seems to play a dominant role so as to facilitate an oxidation-based evaporation in the high temperature enviroment with the decrease of the added oxide of the rare earth metal group. It holds true when the added amount of the oxide exceeds 20% by volume. This is because the increased amount of the oxide changes from an iridium-dominant strucure to an oxide-dominant structure in which the oxide plays an important role to dominate the spark erosion.

As understood from the foregoing description, the grain size and the added oxide of the rare earth metal group are determined in the specified range so as to reduce the occurrence of the blow holes in the solidified alloy layer according to the present invention. The reduced occurrence of the blow holes makes it possible to effectively avoid the thermal stress which eventually causes cracks in the solidified alloy layer 11 due to the heat and cool cycles when the spark plug 1 is in use for the internal combustion engine. As a result, it is possible to sufficiently prevent the firing tip from exfoliating or falling off the columnar metal so as to prolong the service life of the spark plug without doing damage on a cylinder of the internal combustion engine. With the specified addition of the oxide to the high melting point metal, it is possible to effectively control the rise-up of the sprak discharge voltage without inviting an increase of the spark erosion.

It is noted that the firing tip may be used not only to the center electrode but to the ground electrode as well.

It is also noted that the diameter of the neck 16 may be substantially equal to that of the barrel portion 15 instead of using the diameter-reduced neck 16 which is diametrically smaller than the barrel portion 15 of the columnar metal 9.

It is appreciated that the heat-conductive-core 13 may be omitted from the columnar metal 9.

It is observed that the firing tip may be applied to a multi-polarity type spark plug in which a spark gap is provided between a ground electrode and an outer surface of a columnar metal of a center electrode. In this instance, the firing tip is secured to the outer surface of a columnar metal by means of laser or electron beam welding. Upon applying the welding procedure, the firing tip may be thermally fused into the outer surface of a columnar metal.

It is also noted that the firing tip may be formed into stud-like configuration, and one end of the firing tip is firmly placed in a recess which is provided on the front end surface 14 of the clad metal 12 in the columnar metal 9, while other end of the firing tip is projected outside the recess.

Further, it is appreciated that geometrical configuration concerning to the firing tip 10 and the columnar metal 9 may be altered as required.

While the invention has been described with reference to the specific embodiments, it is understood that this description is not to be construed in a limiting sense in as much as various modifications and additions to the specific embodiments may be made by skilled artisan without departing from the spirit and scope of the invention.

What is claimed is:

1. In a spark plug having a nickel-based electrode whose front end has a firing tip made from a ruthenium- or iridium-based metal in which an oxide of a rare earth metal group is dispersed, the spark plug comprising the firing tip welded to the electrode by a solidified alloy layer having a component of the electrode and a component of the firing tip; and the firing tip containing the oxide of the rare earth metal group in a range of 5~15% by volume (V), and an average grain size (D) of the oxide being in a range of 0.05~3.0 μm with a quantitative relationship as $D \leqq -0.34V+5.1$.

* * * * *